US005085268A

United States Patent [19]

Nilsson

[11] Patent Number: 5,085,268

[45] Date of Patent: * Feb. 4, 1992

[54] HEAT TRANSMISSION ROLL AND A METHOD AND AN APPARATUS FOR MANUFACTURING SUCH A ROLL

[76] Inventor: Sven M. Nilsson, Smakullevagen 18, S-430 50 Kallered, Sweden

[ * ] Notice: The portion of the term of this patent subsequent to Jan. 6, 2004 has been disclaimed.

[21] Appl. No.: 524,826

[22] Filed: Aug. 19, 1983

Related U.S. Application Data

[63] Continuation-in-part of Ser. No. 319,442, Nov. 6, 1981, abandoned.

[51] Int. Cl.[5] ..... F26D 19/00

[52] U.S. Cl. ..... 165/8; 29/439; 29/726; 156/184; 156/446

[58] Field of Search ..... 156/205-208, 156/210, 470-473, 184, 190-192, 443, 446; 428/183-185, 188; 165/10, 66, 8; 261/112

[56] References Cited

U.S. PATENT DOCUMENTS

| | | | |
|---|---|---|---|
| 3,086,625 | 4/1963 | Wyatt . | |
| 3,158,527 | 11/1964 | Faccin et al. . | |
| 3,574,103 | 4/1971 | Latkin | 428/185 X |
| 3,943,994 | 3/1976 | Cleveland | 156/210 X |
| 4,633,936 | 1/1987 | Nilsson | 165/8 |

*Primary Examiner*—David A. Simmons
*Attorney, Agent, or Firm*—Harness, Dickey & Pierce

[57] ABSTRACT

The invention concerns a roll comprising two superposed webs of material one of which is formed with transverse ridges. At the ridge bases and tops are formed dents/protrusions. The other web is provided with ribs which are positioned in nesting relationship in the dents/protrusions, whereby the webs are secured to one another. The invention likewise concerns a method and a machine for manufacturing rolls of this kind.

28 Claims, 9 Drawing Sheets

HEAT TRANSMISSION ROLL AND A METHOD AND AN APPARATUS FOR MANUFACTURING SUCH A ROLL

This application is a continuation-in-part of application Ser. No. 319,442 filed Nov. 6, 1981, now abandoned.

BACKGROUND OF THE INVENTION

The subject invention concerns a heat-exchanger roll and a method and an apparatus for the manufacture of heat-exchanger rolls.

In its operational condition, the heat-exchanger forms a rotating wheel, wherein the exchange of heat is obtained by rotating the wheel between flows of fluid of different temperatures so that said fluid flows are heated or cooled by the walls of the channels formed in the wheel.

Heat-exchangers of the type concerned herein are known since 1924. In the technical field to which the subject invention belongs, i.e. recovery of heat/cold with the aid of ventilation air, wheels of this kind began to be used to an increasing degree after the second World War. The energy crisis of 1975 has speeded up the use further.

In the beginning, the wheels were made of strips of asbestos. In the middle of the 1960s the use of webs of aluminium foil was initiated. The corrugated (pleated) and plane (straight) foils were joined together by means of epoxy or polyurethane glue. However, the problems of manufacturing this kind of wheels are considerable, in addition to which their strength and durability are inferior.

The problems arising in the manufacture of wheels of this kind are mainly concerned with the glue. It has to be applied very exactly on the crests of the pleats. In addition, the glue must not spread or be pulled out during the winding-on operation. After the winding-on operation the wheel must be transferred to an oven, wherein the glue is allowed to set. During this process the glue serves as a lubricant encouraging movement between the pleats and the plane foil, which makes the handling of the wheel delicate. During the setting process excess glue has a tendency to spread and block the channels to a larger or smaller extent. In addition, the glue may also be the cause of exzema, allergies and other similar serious illnesses which are difficult to remedy.

A small, often invisible, fault in the glue bond may easily cause the total collapse of the wheel. It is therefore necessary to test the wheels carefully for strength before they are installed.

However, this safety measure is not enough since the strength of the glue bond often deteriorates in some environments as the glue gradually decomposes. This has lead to a large number of wheel collapses, particularly of large wheels of diameter sizes of 3 meters or more, and of heavily loaded wheels. The costs of repair or exchange of such large-size wheels are exceptionally high.

The technical problems involved in obtaining long-term durability and strength of glue bonds in aluminium in moist invironments and the difficulty in solving these problems are well known to the artisans in the field. Various methods have been attempted to solve these problems.

The safest—but also the most expensive—way of solving the problem is to cut the wheel into segments, after the glueing operation, and to insert the segments in self-supporting frames. The method is very complicated and expensive. Another method uses 4 to 8 spokes which are inserted into channels milled into the two faces of the wheel to take the majority of the strain. This method is used predominantly in smaller wheels having a maximum diameter of about 1.5 to 2 meters.

A third method also uses 4 to 8 spokes which are hammered or drilled diametrically through the wheels after the wheel-glueing operation. This method is used generally by several manufacturers.

The spokes, however, reduce the through-flow area and complicate the manufacture. In addition, the long-term effect has not yet been tested.

The purpose of the subject invention is to eliminate the glueing operation completely while at the same tim e provide considerably more efficient exchange of heat than in heat-exchangers fitted with rolls of prior-art types.

SUMMARY OF THE INVENTION

In accordance with the invention are used two superposed webs of material and a core sleeve having a longitudinal axis about which the roll rotates in use, said webs being wound about said core sleeve, the first one of said webs provided with transverse equidistantly spaced ridges defining substantially unrestricted longitudinally extending flow channels extending parallel to said axis and the second one of said webs provided with lengthwise ribs. The characteristic feature of the invention resides therein that the indentations formed in the ridges of said first web at the ridge top as well as the ridge bases, said ribs formed in said second web engaging in said indentations formed in the first web to mechanically interlock said webs.

The method in accordance wit the invention is characterised by applying on one of the webs, at the web winding-on station, a pressure which is exerted in the radial direction of the roll in order to press the dents formed in said web into the matching ribs formed in the second web and in order to press together the winding turns making up the roll.

The apparatus in accordance wit the invention comprises a station designed to impart the profile configuration of the first web through rolling, said station designed to impart cross-wise ridges and grooves in said web, said ridges and grooves formed at the crests and bottoms with respectively protrusions/dents, a second station designed to impart lengthwise ribs in the second web, and a winding-on station wherein the two webs are wound onto one another in superposed relationship to form the roll. The apparatus is characterised in that means are provided to press the two webs together and to exert a retarding action thereon in order to impart a lengthwise tension in said webs when they are wound into a roll in the winding-on station.

Further characteristics of the invention will become apparent from the dependent claims.

DETAILED DESCRIPTION OF A PREFERRED EMBODIMENT

A heat-exchanger roll 10 of the kind described in the introduction hereto consists of two webs of material, preferably of aluminium foil, a first web 12 and a second web 14. At the onset of the manufacturing process the two webs are wound onto supply rolls, denominated respectively 16 and 18.

Figure 1:
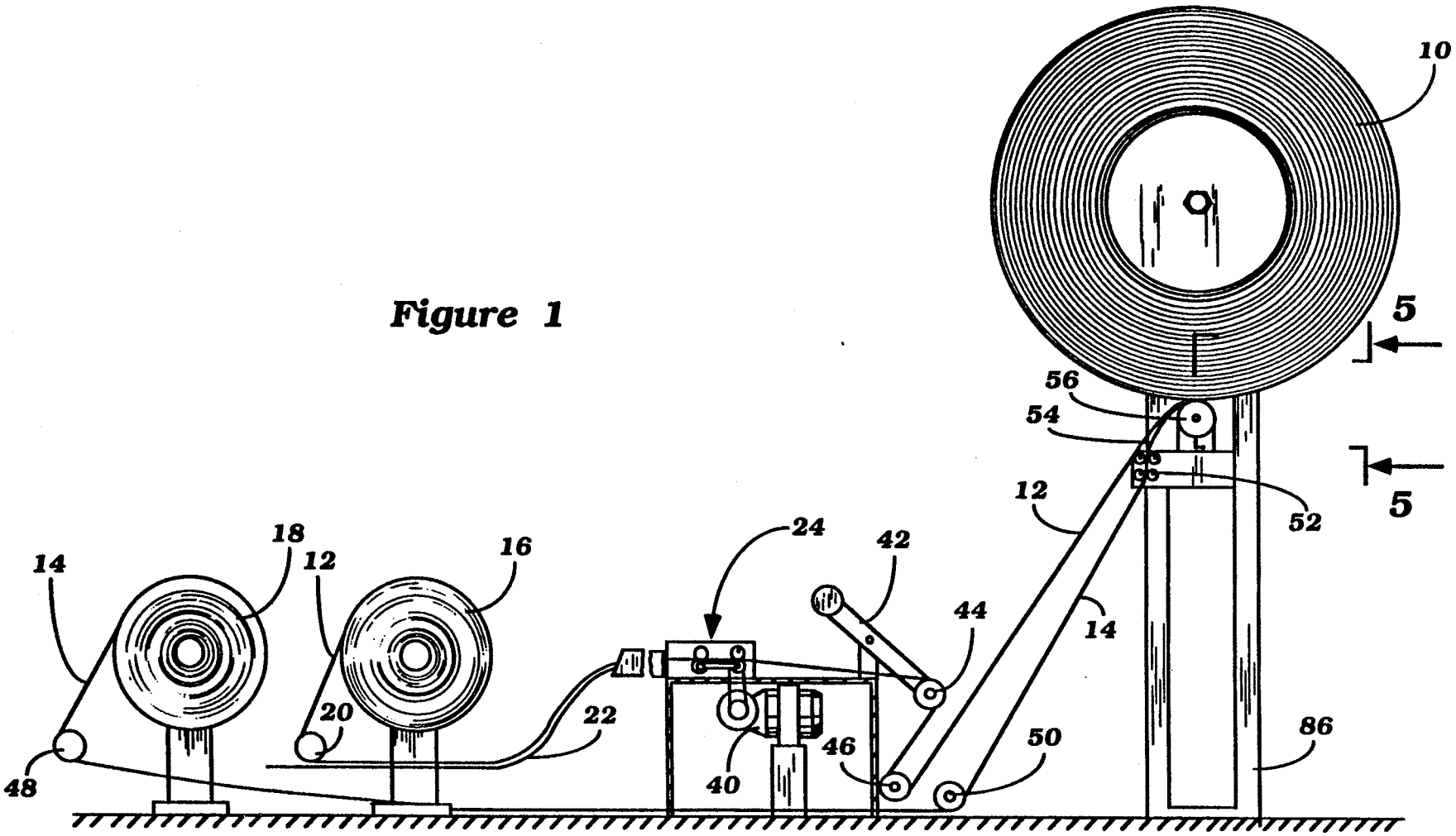
FIG. 1 is a general lateral view of an apparatus in accordance with the invention.
Figure 3:
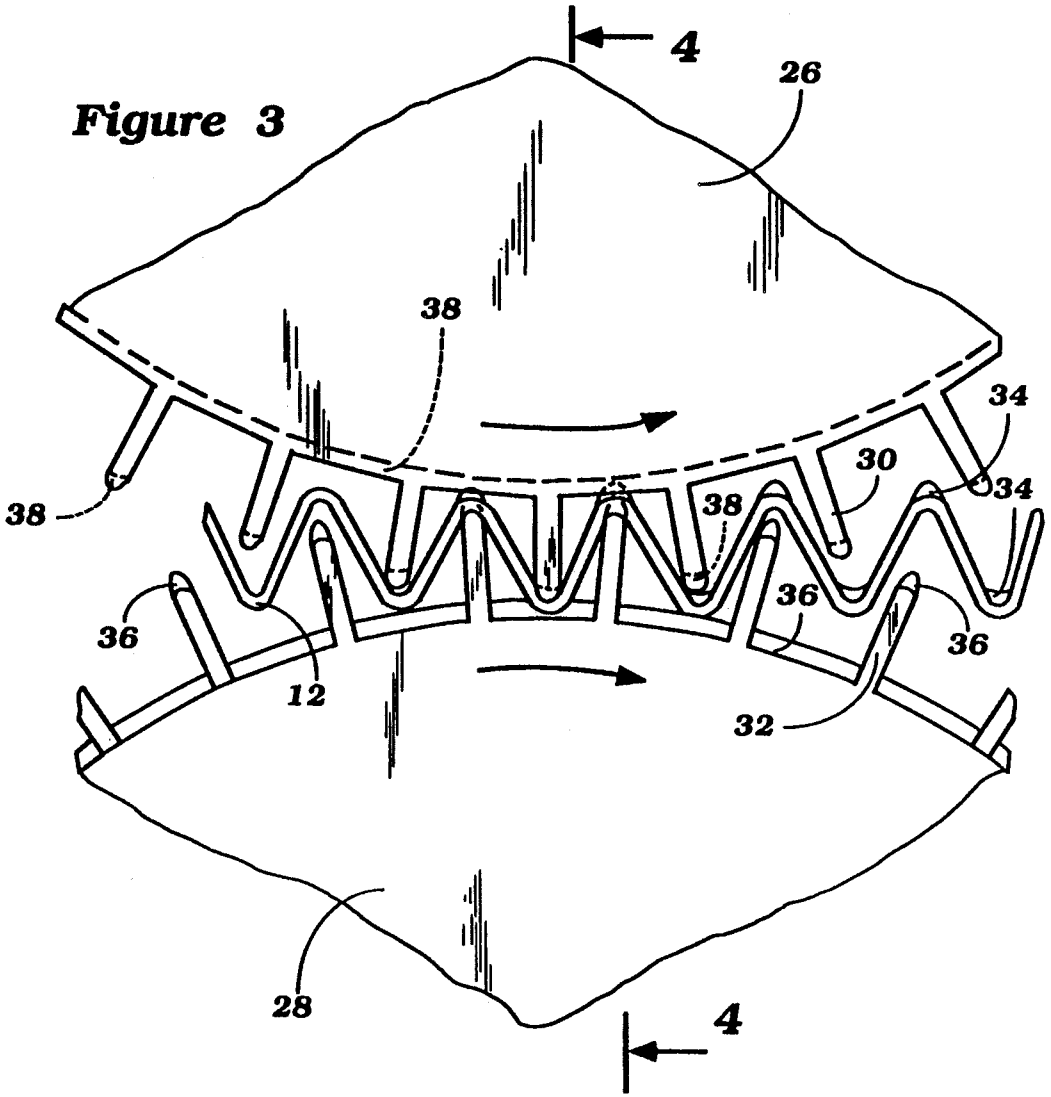
FIG. 3 is a partial view from the side of a pair of rollers forming part of the apparatus in accordance with the invention.
Figure 4:
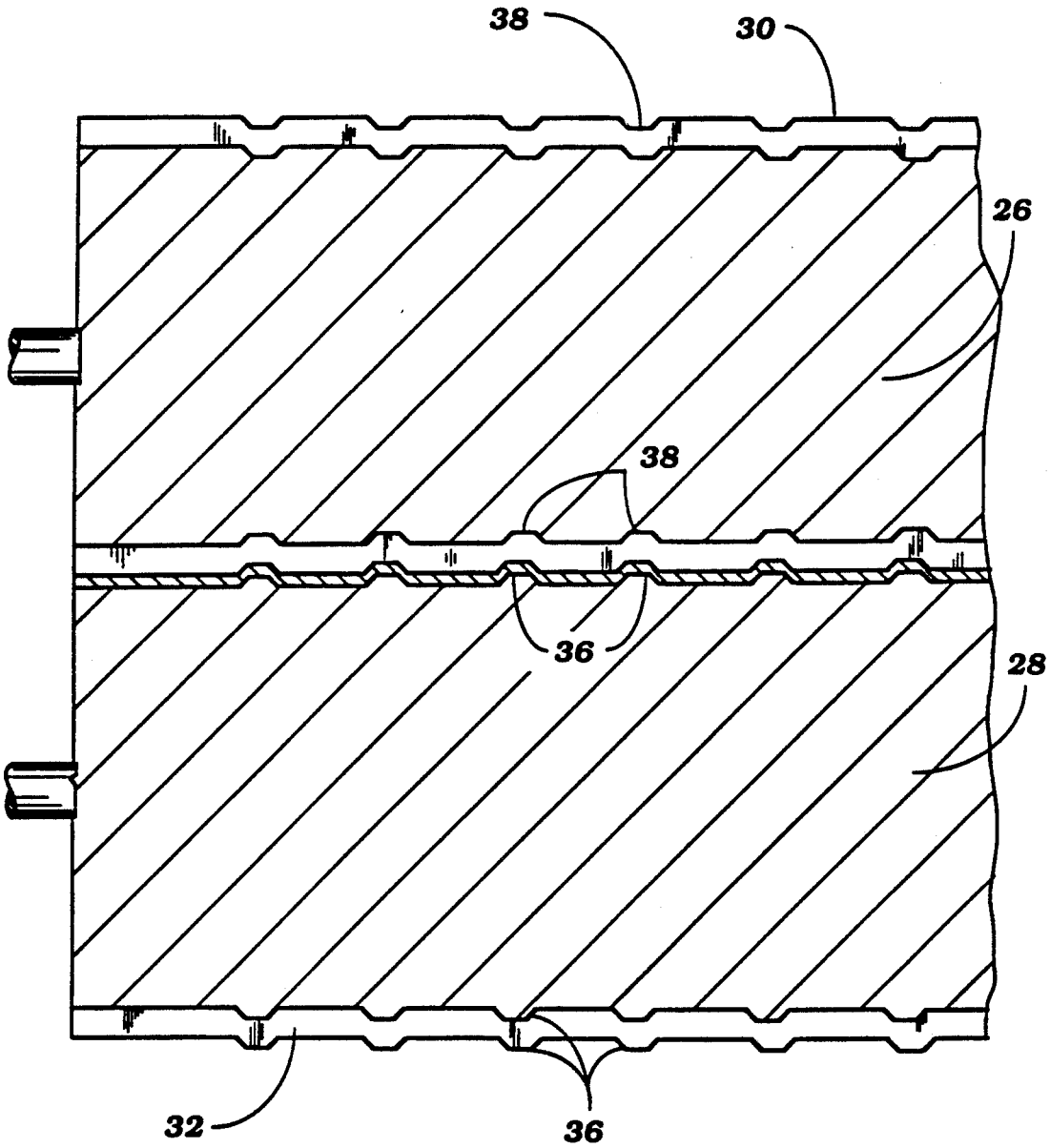
FIG. 4 is a cross-sectional view of the same pair of rollers as seen along line IV—IV of FIG. 3.

The first web 12 is supplied from the roll 16 and is carried over a jerks and pressure compensating device 20 and further onto a plate 22 up to a roller station 24. The latter comprises two pairs of rollers, one of which consists of rollers 26 and 28 and is shown in FIGS. 3 and 4. These rollers 26, 28 are provided with axially extending flanges 30 and 32, respectively, which are positioned at even pitch spacings across the two rollers 26, 28. The roller 28 is formed with projecting members 36 on the flanges 32 and the roller body proper, these projecting members 36 serving to shape protrusions/-dents 34 at respectively the crests and bottoms of the corrugations formed in the web 12. The opposite roller 26 of the pair is formed with matching indents 38 extending peripherally across the cylindrical face of the roller and also in the flanges 32. Before the web 12 arrives up to roller pair 26, 28 corrugations are made therein as the web passes through the nip of a first pair of rollers forming roller station 24. In an embodiment of the invention the indentions at the crests may be offset from those at the bottoms by half a pitch. The first pair of rollers is similar to roller pair 26, 28 but has no members corresponding to the projecting members 36 or to the indents 38. The two roller pairs of roller station 24 are driven in mutual synchrony by a motor 40.

The web 12 is carried further to a pendulum means 42 and over a wheel 44 suspended at the end of one of its arms. The pendulum serves to equalize tensile stress in the web 12. The pendulum 42 is provided with a sensing means (not shown but preferably consisting of a potentiometer positioned at the journalling point of the pendulum 42), said sensing means arranged to emit a signal to control the speed of the motor 40.

From the pendulum 42 the web 12 is carried around a fixed deflector wheel 46 and from there to the winding-on station.

The second web 14 of material is wound off the roll 18 and is carried over a pressure or jerk compensating member 48 corresponding to compensating member 20. From the compensating member 48 the web 14 is carried to a deflector roller 50 corresponding to the deflector roller 46 serving web 12. The web 14 is carried further up to a second roller station 52 comprising two pairs of rollers arranged to shape lengthwise ribs into the web 14. For this purpose one of the rollers of the pair is provided with circumferentially extending ridges on its cylinder face whereas the second roller of the pair is formed with matching grooves. The ribs of the web 14 match the protrusions/dents 34 of the web 12.

The roller station 52 also comprises a sensing means (preferably in the form of a tachometer, not shown), which is arranged to emit controlling signals to the motor 40 to adjust the speed thereof to the advancing speed of the web 14.

The two webs 12 and 14 are wound into the heat-exchanger roll 10. A plate 54 is arranged to guide the web 14 laterally when the web is wound onto the roll 10. The second web 12 abuts against the web 14 and is guided laterally towards the roll 10. A pressure roller 56 provided with beads 57 which are shaped to match the ribs formed in the web 14 is arranged to exert a pressure against the roll 10 during the winding-on operation, which means that each newly wound-on turn of the webs 12, 14 is pressed into the already wound-on turns with the protrusions/dents of web 12 intermeshing with the ribs of web 14. This results in a safe gripping bond between the webs 12, 14 and avoidance of play between the web winding turns. In addition any unevenness is straightened out. In operation, the heat-exchanger wheel will be exposed to stress in its axial direction, such stress being exerted by the air flowing through and against the heat-exchanger roll 10. The ability to take such stress is highly improved by a wheel wherein the winding turns are pressed hard together in accordance with the invention. During winding-on of the roll, the webs 12, 14 are also stretched by the braking action exerted on the pressure roller 56. Stretching of the webs means that the effect of the pressing-together action and of the tension imparted to the webs by means of the pressure roller 56 are permanented and remain in the finished roll 10.

The outermost turns of the wheel 10 are riveted together and/or the wheel 10 is equipped with an external ring keeping the wheel together and maintaining the tension imparted to the wheel during the winding operation.

Figure 2:
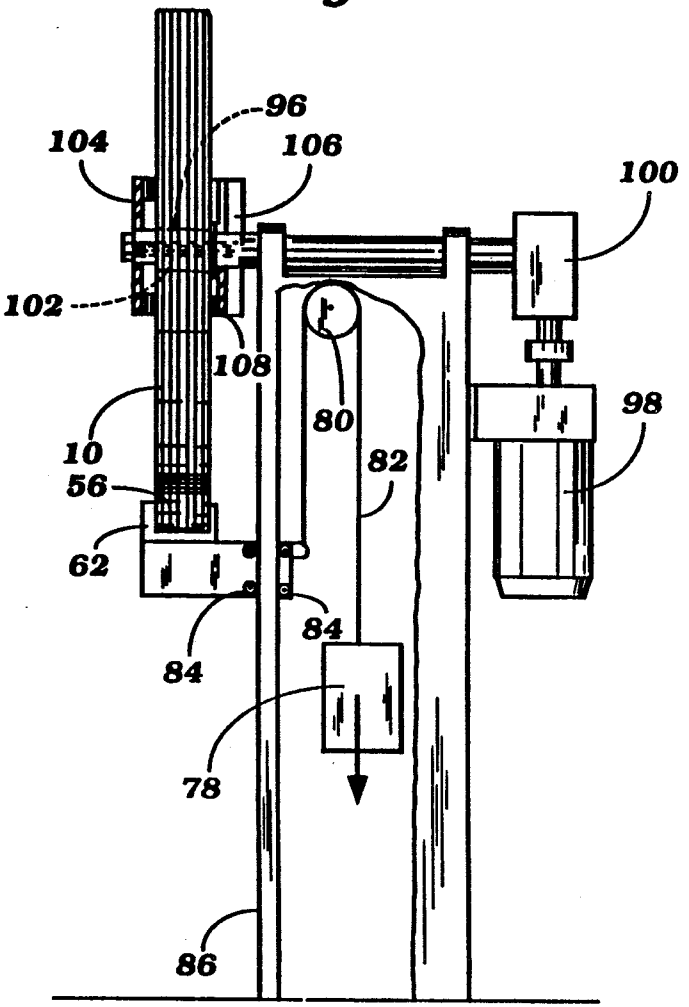
FIG. 2 is a view of the apparatus as seen from the right with reference to FIG. 1.
Figure 5:
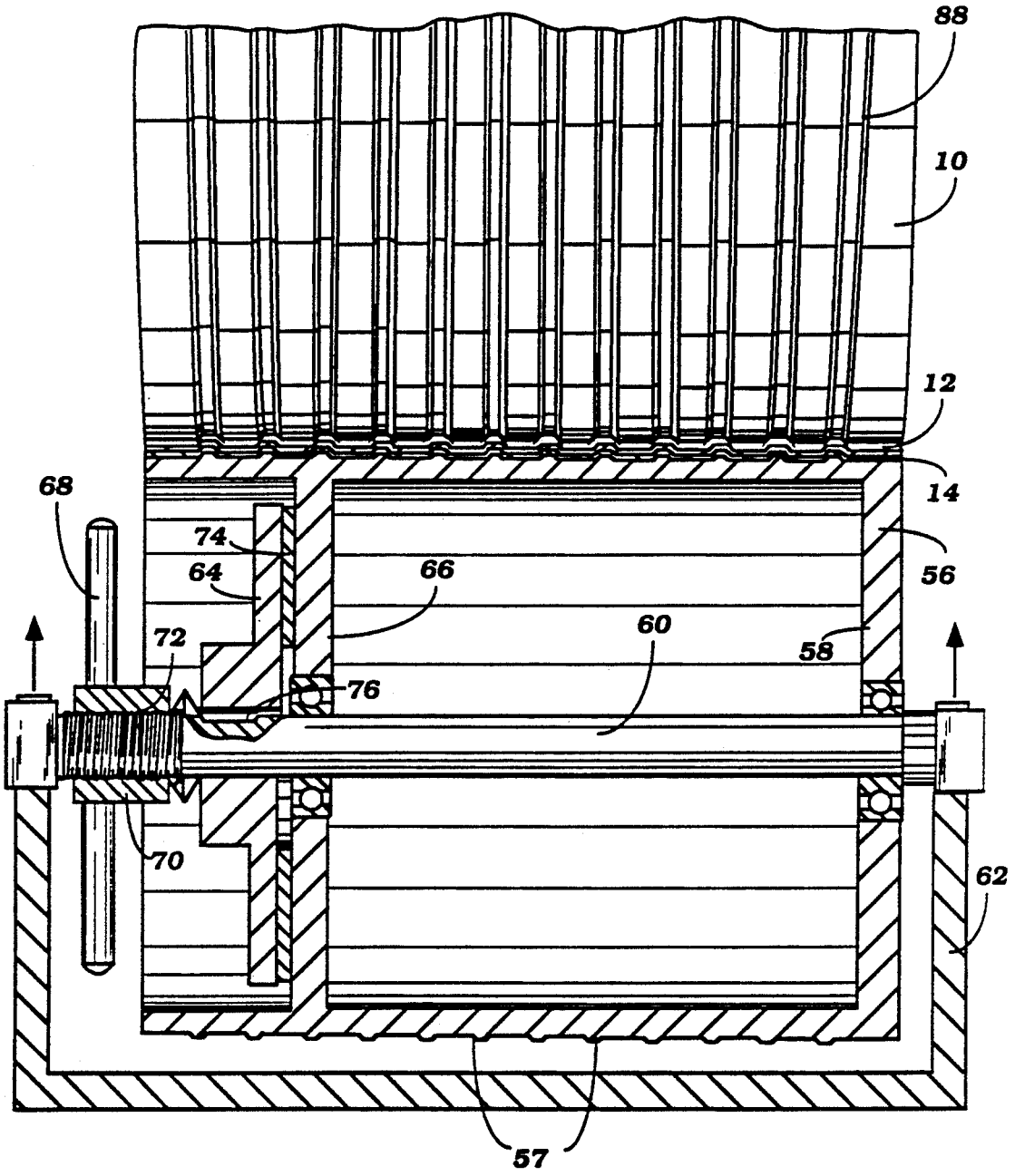
FIG. 5 is a cross-sectional view on a larger scale along line V—V of FIG. 1 through a pressure roller designed to abut against a heat-exchanger roll manufactured by means of an apparatus in accordance with the invention.

The pressure roller 56 is shown in FIG. 5 and consists of a cylindrical body 58 which is rotatably mounted on a shaft 60. The latter is removably but non-rotationally mounted in a frame 62. A brake disc 64 is arranged to be pressed against one of the end walls 66 of the cylindrical body. This is effected with the aid of a bolt 70 which is provided with projecting arms 68 and which is screwed onto threads 72 formed on the shaft 60, whereby the brake shoes 74 of the brake disc 64 are pressed against the cylinder body end wall 66, effecting a braking action on the pressure roller 56. The brake disc 64 is formed with a flange running in a groove 76 formed in the shaft 60, thus preventing the brake disc 64 from being rotated upon braking. The pressure roller 56 is pressed against the roll 10 by a counter-weight 78 (see FIG. 2) to which it is attached by means of a wire 82 carried about a pulley 80 and attached to the frame 62 of the pressure roller. The frame 62 is provided with wheels 84 which are arranged to run along the stand 86 supporting the wheel 10 and controlling the movements of the frame 61.

Figure 6:
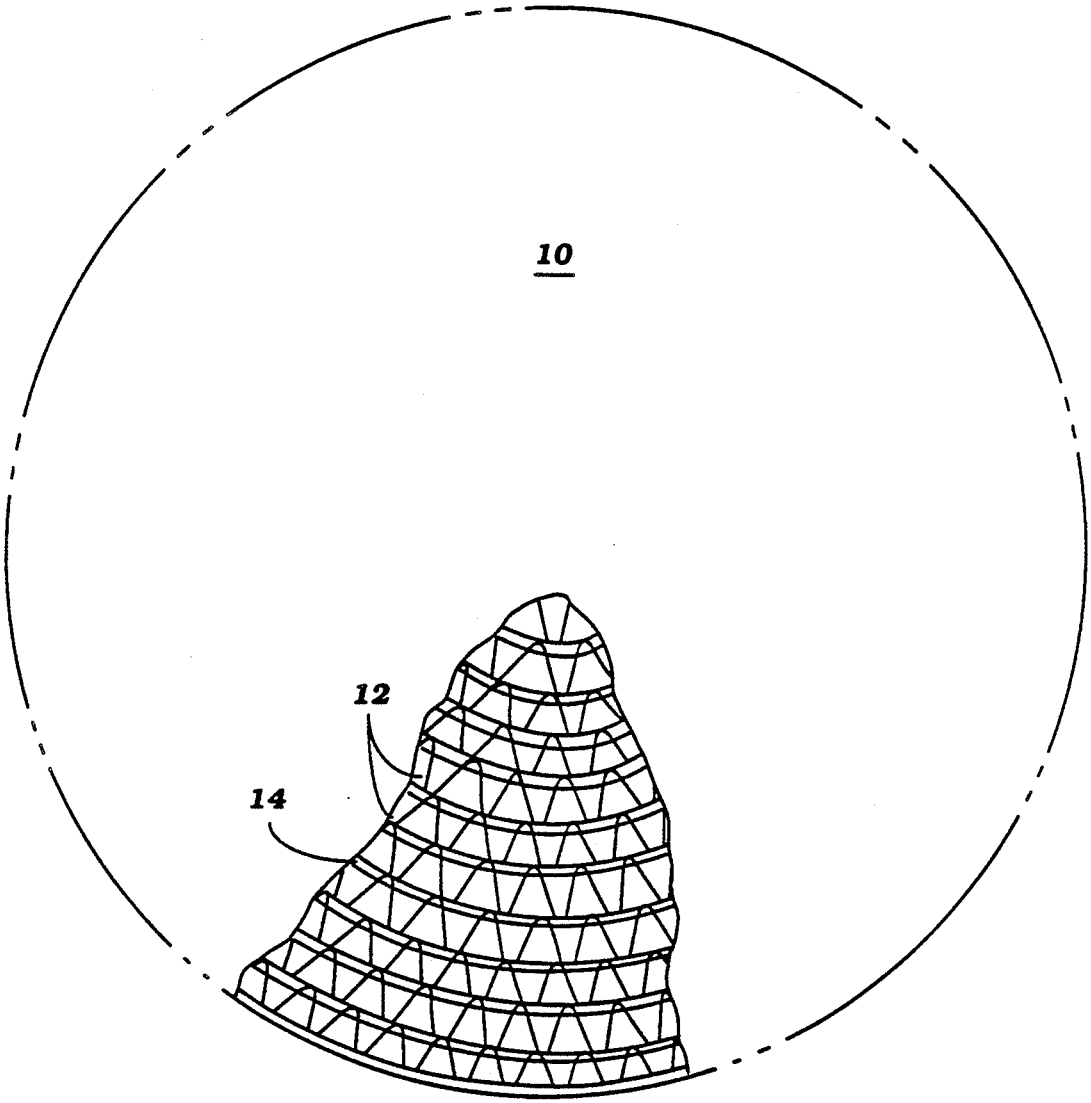
FIG. 6 is a general view of a heat-exchanger roll.
Figure 7:
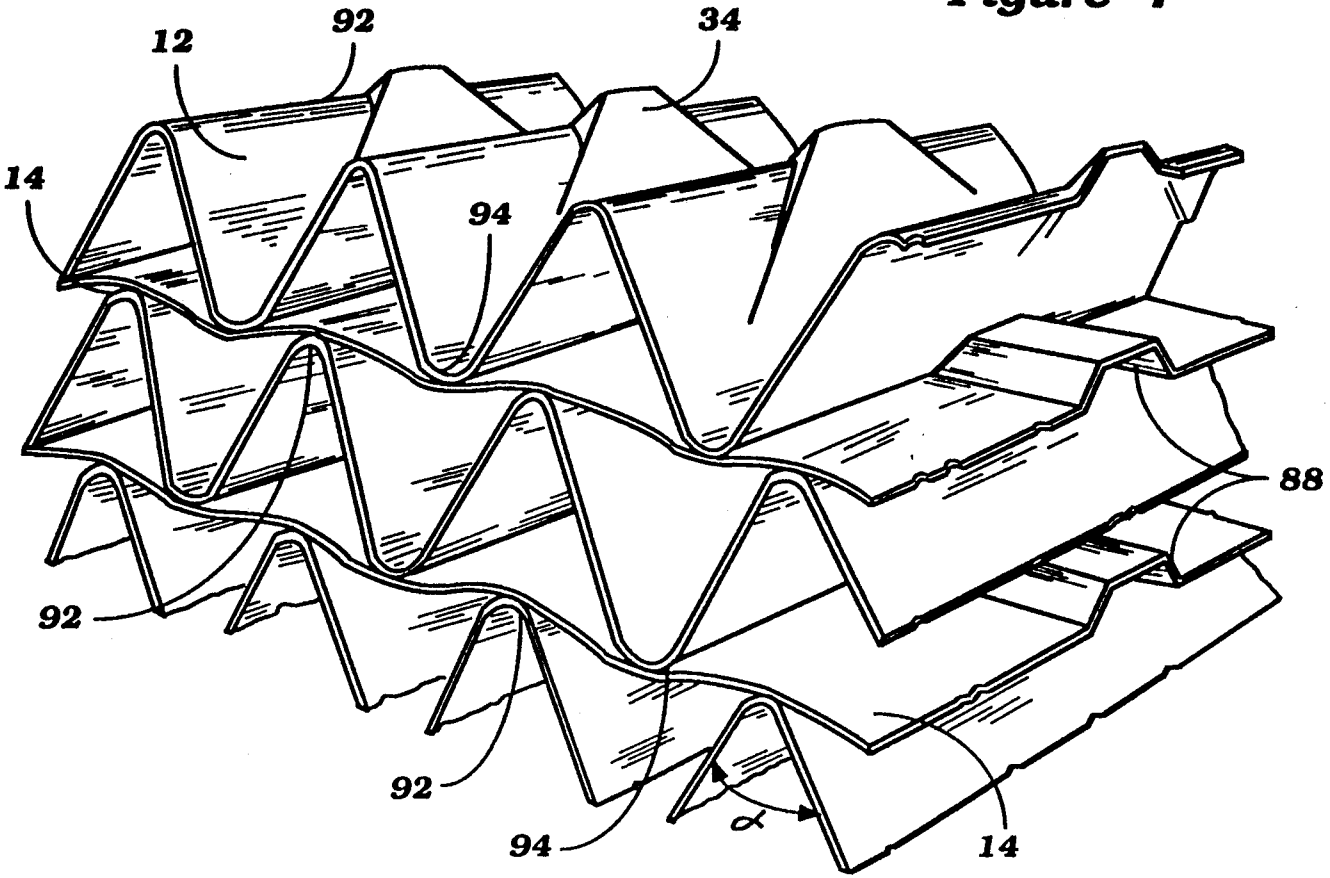
FIG. 7 is a detail view of a part of the heat-exchanger wheel, showing the principle of the design thereof.
Figure 8:
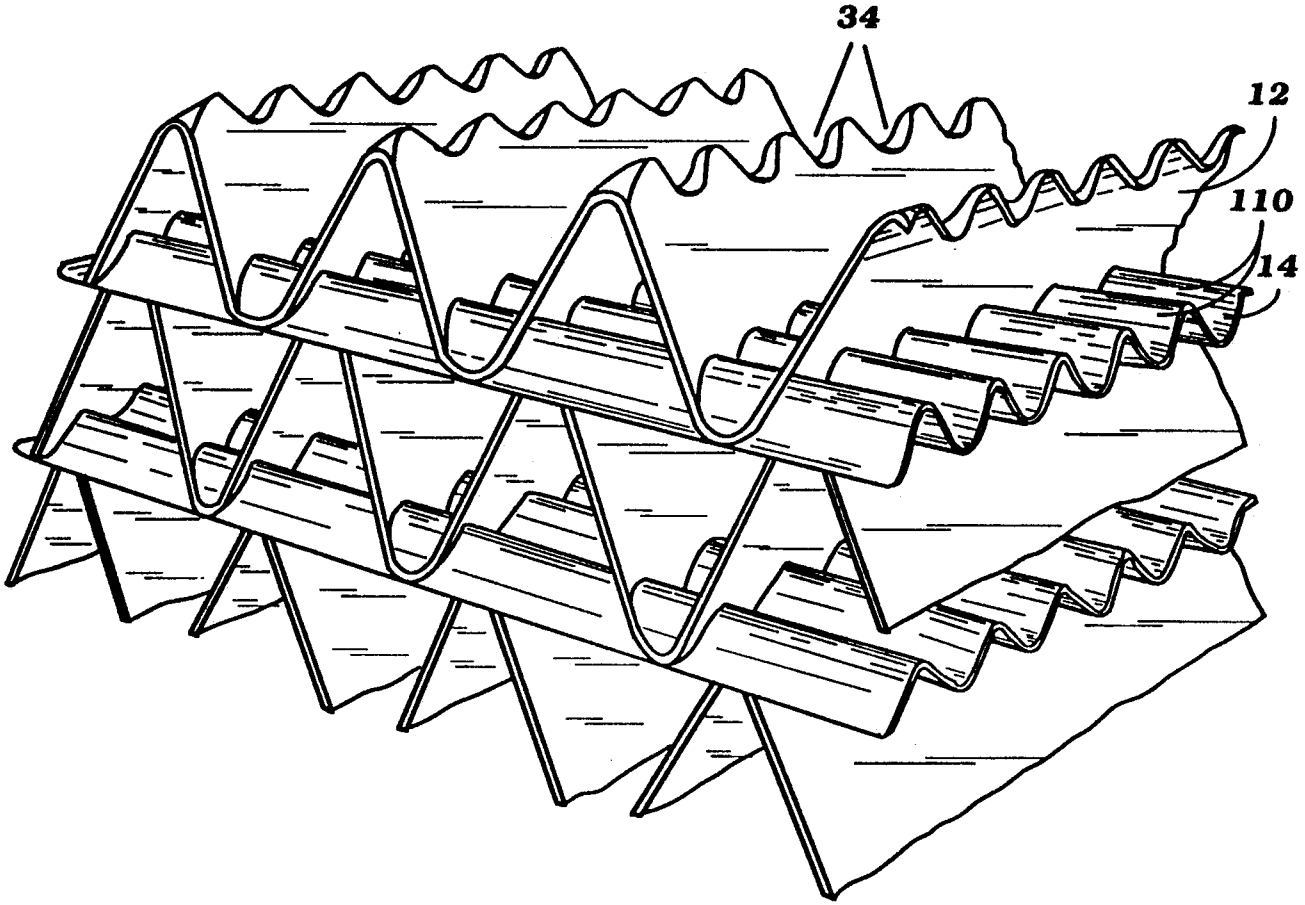
FIG. 8 is a perspective view of a second embodiment of the roll.
Figure 10:
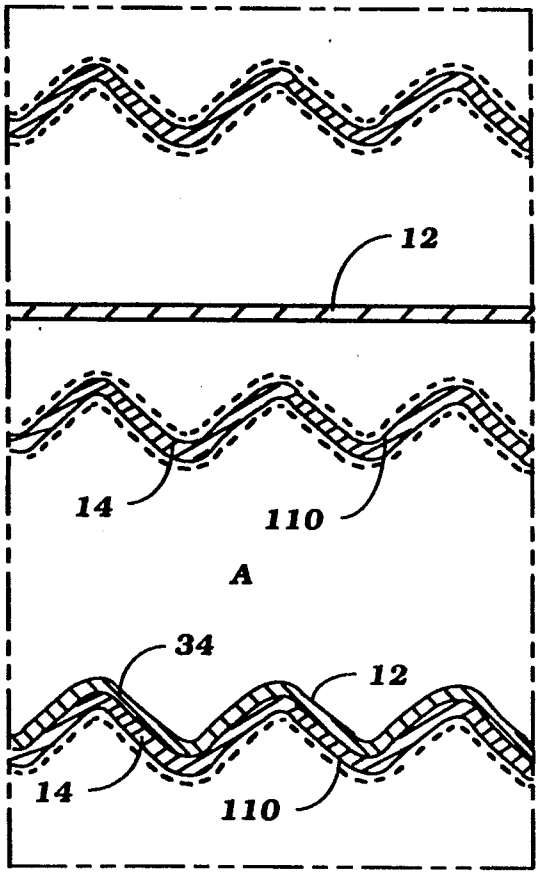
FIG. 10 is a section along line IX—IX in FIG. 9 in the longitudinal direction of the roll.
Figure 9:
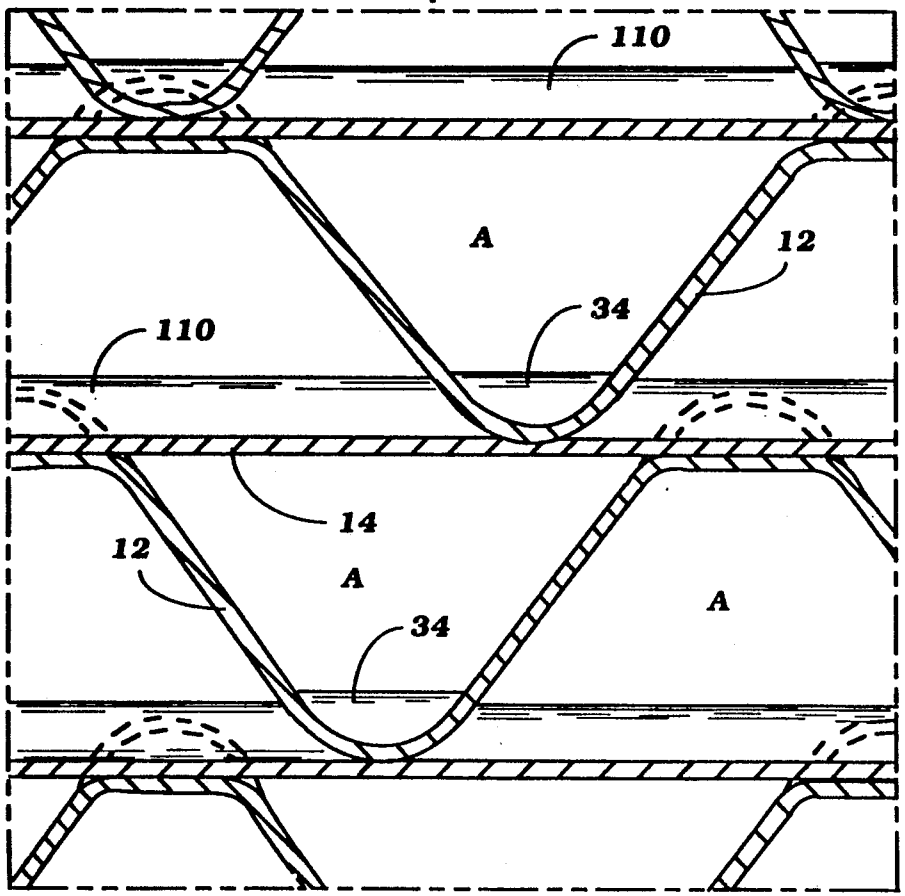
FIG. 9 shows on an enlarged scale a cross-sectional view through a part of the roll.
Figure 11:
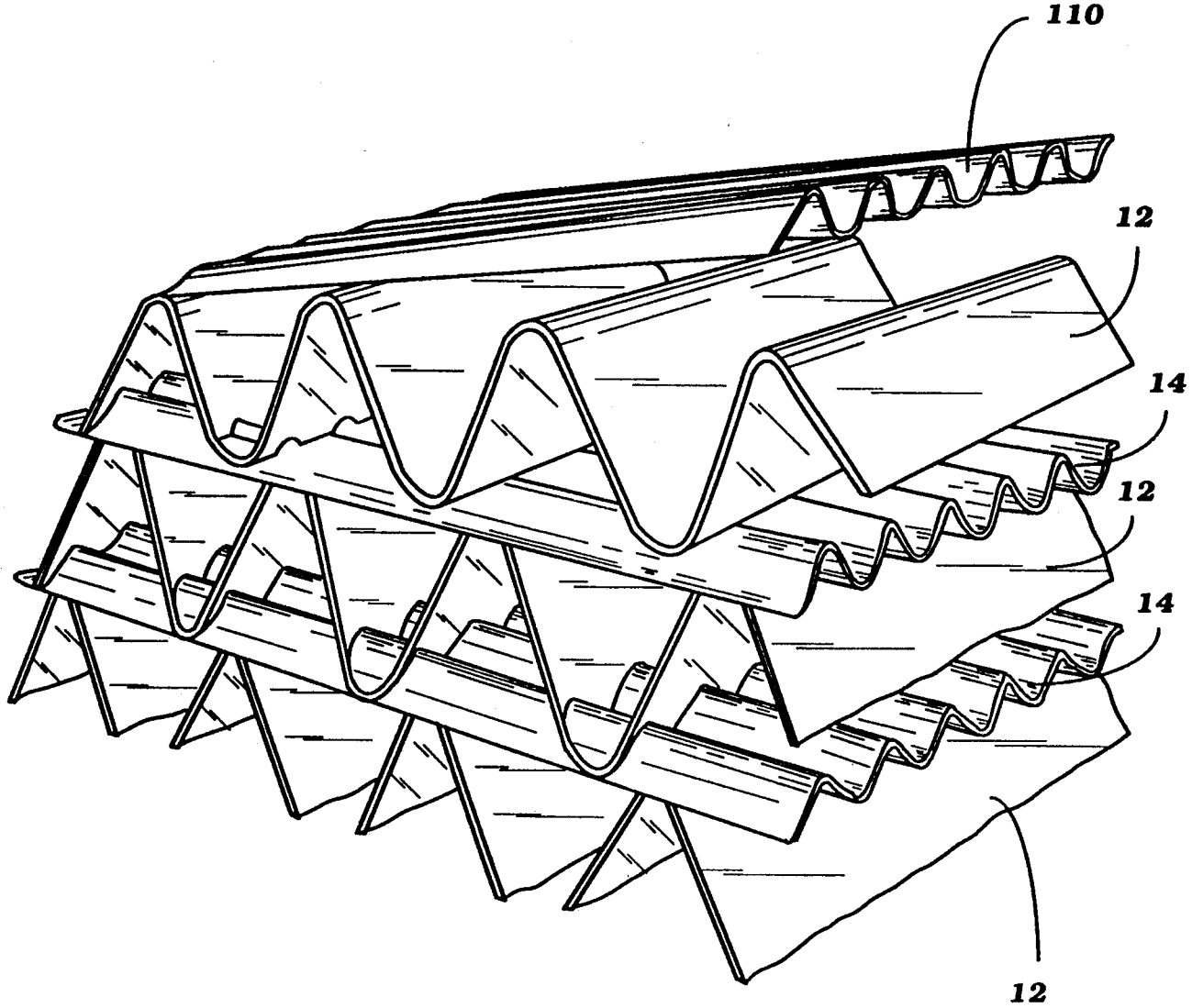
FIG. 11 is a perspective view of a heat-exchanger in accordance with a third embodiment of the invention.

FIGS. 6 and 7 show the general appearance of the heat-exchanger roll 10 and the principle of its structure. FIG 7 shows a section of the roll 10. For the sake of simplicity, the view of FIG. 7 does not take into consideration the curvature of the roll 10. FIG .7 shows clearly the provision in web 14 of lengthwise ribs 88 and in web 12 of matching protrusions/dents 34 formed at respectively the ridge crests and the groove bottoms of the corrugations formed in the web 12. The interengagement is effected between the protrusions/dents 34 and the ribs 88 during the winding-on of the webs 12, 14 into the wheel 10. It should be mentioned that the ribs 88 formed in the web 14 are dimensioned to ensure that the relationship between the width at the upper rib edge, the width at the lower rib edge and the rib spacings across the web 14 is approximately 1:2:8.

As appears from FIG. 7 the ridge crests 92 of the corrugations of the web 12 will, upon winding-on of the webs 12, 14, be displaced in the majority of the winding turns in relation to the groove bottoms 94 of the immediately adjacent winding turn of the web 12. When the pressure roller 56 presses the various winding turns together tis results in such a deformation of the web 14 that in the manner illustrated in FIG. 7 this web will take on a wavy configuration in its lengthwise extension. This lasting resilient deformation of the web 14 ensures that the two webs are held firmly together during the operation of the wheel 10 and consequently is a further guarantee against separating forces acting axially on the wheel 10.

Experiments made with heat-exchanger rolls manufactured in accordance with the invention show that with suitable choices of the pressures and of the braking force with which the pressure roller 56 acts upon the webs 12, 14 upon their winding-on onto the roll 10, a roll 10 may be obtained having such characteristics that it remains within its elasticity range/area when exposed to the deformation forces that occur during normal operation. When an angle $\alpha$ of 65° is chosen for the corrugations a pressure of the magnitude of 50N and a braking force of 70N result in a wheel 10 that possesses characteristics that make the wheel fully satisfactory in operation. When larger tensional forces are chosen, further improved operative characteristics are obtained and the elasticity range/area is widened.

The roll 10 is wound onto a shaft 96 serving as a winding core. During the winding-on operation the shaft is driven by a motor 98 which is connected to the shaft 96 via gear mechanism 100. The shaft 96 is in the shape of a sleeve and is provided with an internal axially movable shaft 102 the outer end of which projects beyond the sleeve shaft 96 and is formed with threads on which an outer relief disc 104 may be attached. At its opposite end the inner shaft 102 is provided with through-holes or grooves in which is mounted a bar 106, which bar also runs through a groove in the outer shaft 96. The bar 106 is arranged to urge an inner relief disc 108 against the roll 10 in order to clamp the latter in position between the discs 104, 108 during the winding of the roll so that when the wound roll 10 has reached a predetermined size the discs act to relieve the inner winding turns of the roll 10 when further turns are wound thereon. The inner shaft 102 rotates together with the sleeve-shaped shaft 96. The construction comprising an inner, axially movable shaft 102 allows some axial movement of the relief discs 104, 108 relative to the shaft 96, which further increases the clamping effect obtained with the aid of the relief discs 104, 108.

It is possible to form the web 14 with waves 110 instead of with the ribs 99 (FIGS. 8–11). The waves 110 and the protrusions/dents 34 form through-flow channels A for the medium flowing through the heat-exchanger of the appearance shown in FIG. 10. This configuration results in an enlargement of the heat-transmission area. The flow through the roll 10 according to the invention will be turbulent and not laminar. In laminar flows (which would have been the case had the limiting faces of the channels been completely straight) the layer of the medium flowing closest to the limiting faces acts as insulation, preventing the rest of the medium from contacting these faces. The turbulent flow generated in the channels of the roll in accordance with the invention means that a larger portion of the flowing medium will come into close contact with the limiting faces. The effect of this phenomenon and the enlargement of the heat-transmission area of the channels A as a result of the provision of the ribs 88 or the waves 110 make for considerably improved exchange of heat.

It is possible to shape the web 12 without protrusions/dents 34 prior to the winding-on of the roll 10. This is because the web 14 is formed with waves 110 in its lengthwise direction in the manner appearing from FIG. 11, and a comparatively secure bond can be obtained between the two webs by highly tensioning the web 14 so that it presses into the ridges and the depressions in the web 12, impressing protrusions/dents therein matching the waves 110 formed in the web 14.

In order not to lose the tension in the web 14 it is necessary, after completion of the winding-on operation and when the heat-exchanger roll 10 is finished off, to anchor the trailing end of the web 14 safely to the heat-exchanger. This could be effected e.g. by adhesion. A cover is applied on the finished heat-exchanger, the cover being e.g. a metal web which is riveted together to the desired cover configuration.

The embodiments of the invention described above are to be regarded merely as examples thereof and a variety of modifications are possible within the scope of the appended claims. For instance, the pressure force by means of which the pressure roller 56 acts on the wheel 10 could be obtained by hydraulic or pneumatic means rather than by a counter-weight 70. Also it may be desirable to further enhance the interlocking of the webs by surface treating them to increase their friction.

What I claim is:

1. An improved roll intended for transmission of heat, comprising two superposed webs of material and a core sleeve having a longitudinal axis about which the roll rotates in use, said webs being wound about said core sleeve, the first one of said webs provided with transverse equidistantly spaced ridges defining substantially unrestricted longitudinally extending flow channels extending parallel to said axis and the second one of said webs provided with lengthwise ribs, the improvement comprising indentations formed in the ridges of said first web at the ridge tops as well as the ridge bases, said ribs formed in said second web engaging in said indentations formed in the first web to mechanically interlock said webs.

2. An improved roll according to claim 1, wherein said indentations formed at the ridge tops of said first web are displaced by half a pitch relative to said indentations formed at the ridge bases of said first web.

3. An apparatus as claimed in claim 1 wherein the webs of material are a foil.

4. An apparatus as claimed in claim 3 wherein the foil is formed from aluminum.

5. A roll type laminated heat exchanger structure having a longitudinally extending rotational axis defining a plurality of longitudinally extending, substantially uninterrupted flow channels comprising a first corrugated member having alternately disposed, longitudinally extending crests and valleys defining longitudinally extending gaps therebetween, said crests and said valleys each being formed with a plurality of transversely aligned surface discontinuities therein formed by deformations of the material thereof, and a second corrugated member engaged with one side of said first member and having a plurality of transversely extending surface discontinuities adapted to interlock with transversely aligned surface discontinuities in the peaks of said first member when received on the upper side thereof to interlock said first and said second members together.

6. A roll type laminated heat exchanger structure as set forth in claim 5 wherein at least certain of the transversely extending surface discontinuities of the second member are adapted to interlock with the surface discontinuities in the valleys of the first member when a first member is positioned thereupon for mechanically interlocking the members together.

7. A roll type laminated heat exchanger structure as set forth in claim 6 wherein the laminated structure comprises a roll wound around a core sleeve and which defines the longitudinal axis.

8. An apparatus as claimed in claim 5 wherein the corrugated members are formed from a foil.

9. An apparatus as claimed in claim 8 wherein the foil is formed from aluminum.

10. A heat exchanger comprising two metal webs arranged in superposed relationship and wound about a core, a first of said webs being formed with corrugations extending in the crosswise web direction, said corrugations forming axially extending channels throughout said heat exchanger, said heat exchanger forming, in its operational condition, a rotating wheel wherein the exchange of heat is obtained by rotating the wheel between flows of fluid of different temperatures so that said fluid flows exchange heat with the walls of said channels, said two webs being joined together through mutual frictional abutment, said second web being highly tensioned in its lengthwise direction, whereby the two webs will be pressed hard together, said second web being attached at its outer end relative to the rest of the wheel, said second web having a wavy configuration with said waves extending in the lengthwise web direction, said waves pressing into the ridges and depressions of the corrugations formed in said first web for interlocking said webs together.

11. A heat exchanger in accordance with claim 10, characterized in that the surfaces of said webs are surface-treated to increase the friction.

12. A heat exchanger in accordance with claim 11 wherein the trailing end of the second web is attached to the heat exchanger, and further including a cover applied about said heat exchanger.

13. An apparatus as claimed in claim 10 wherein the webs of material are a foil.

14. An apparatus as claimed in claim 13 wherein the foil is formed from aluminum.

15. An improved method of manufacturing rolls consisting of two superposed webs of material wound about a core sleeve having a longitudinal axis about which the roll rotates in use, comprising rotatably driving said core sleeve, winding onto said sleeve said two superposed webs of material, the first one of said webs formed with transverse ridges defining substantially unrestricted flow channels extending parallel to the longitudinal axis of said core sleeve and the second one of said webs formed with lengthwise ribs, the improved method comprising the steps of forming transversely aligned sets of surface discontinuities on said ridges in said first web at the ridge tops as well as the ridge bases, said discontinuities having a pitch matching that of said ribs formed in said second web, and guiding at least one of said webs to securely position said ribs in engagement with said discontinuities for mechanically interlocking said webs.

16. A method as set forth in claim 15 wherein the webs are formed from a foil material.

17. A method as set forth in claim 16 wherein the foil material is aluminum.

18. A method of manufacturing heat exchanging wheels comprising the steps of corrugating a web of material, forming respective outwardly extending projections in the crests of at least one side of the corrugated web and extending transversely to the corrugations at a height of less than the depth of the corrugations, corrugating a second web of material, winding the corrugated webs onto a core which defines the axis of rotation of the heat exchanger wheel, applying a pressure upon the first of the webs during said winding in the radial direction of the wheel sufficient to press the projections formed in the first web into matching recesses formed in the other web for interlocking the webs together.

19. A method as set forth in claim 18 wherein the recesses in the other web are formed prior to the winding operation.

20. A method as set forth in claim 18 wherein the recesses in the other web are formed by the pressure applied to the other web by the projections of the first web during the winding operation.

21. An apparatus for manufacture of a heat-exchanger roll, said apparatus comprising a first station for profile rolling a first web of material, said first station including means for corrugating the first web to impart crosswise ridges and grooves to the first web, the ridge crests and groove bottoms provided, respectively, with protrusions, a second station for forming lengthwise ribs in the second web, and a winding-on station for winding the two webs onto one another about a core in superposed relationship and means for pressing the two webs together and to exert a retarding action thereon in order to impart a longitudinal tension in the webs when they are wound into the roll in the winding-on station.

22. An apparatus as claimed in claim 21 wherein the means for pressing together and retarding the two webs during the winding-on operation comprises a pressure roller provided with beads and pressed against the web which is provided with the lengthwise ribs during the winding-on of said web.

23. An apparatus as claimed in claim 22, characterized in that the pressure roller having beads thereon is connected with a weight arranged to impart to the pressure roller the force required to press together and retard the webs.

24. An apparatus as claimed in claim 21 whereas the first roller station comprises a pair of rollers, each provided with axial flanges, one of said rollers being provided with grooves, and the second of said rollers being provided with projecting members, said grooves and said projecting members functioning to form the lengthwise protrusions in the corrugated web.

25. An apparatus as claimed in claim 24, characterized in that the pair of rollers is driven by a motor, said motor being effective to drive said pair of rollers at a controlled speed, and further including a pressure-equalizing pendulum means positioned following the roller station in the travelling direction of the web, a wheel mounted on one arm of said pendulum means and over which said web travels, and said pendulum means being connected to a means sensing said pendulum means position and designed to emit a control signal to the motor to adjust the speed thereof.

26. An apparatus as claimed in claim 22, characterized in that the pressure roller having beads thereon is equipped with a disc brake means to retard the web formed with lengthwise ribs when said web is being wound onto the roll.

27. An apparatus as claimed in claim 21 characterized in that the second roller station is connected to sensing means for emitting a signal to control the speed of a motor that drives the first roller station.

28. An apparatus as claimed in claim 21 characterized in that a sleeve-shaped shaft is provided to serve as the core onto which are wound the webs into the roll and further including an inner, axially movable shaft mounted inside said sleeve-shaped shaft, said inner shaft being formed with a threaded end portion which may be extended out of said sleeve-shaped shaft, an outer relief disc mounted on said end portion, said inner shaft being connected with a means for urging an inner relief disc against said roll for clamping said roll between said two relief discs, said relief disc being axially movable relative to the sleeve-shaped shaft by means of said inner, axially movable shaft.

* * * * *

UNITED STATES PATENT AND TRADEMARK OFFICE

CERTIFICATE OF CORRECTION

PATENT NO. : 5,085,268

DATED : February 4, 1992

INVENTOR(S) : Sven M. Nilsson

It is certified that error appears in the above-identified patent and that said Letters Patent is hereby corrected as shown below:

On the Title Page, insert the following heading and information:

--Foreign Application Priority Data--

--Nov. 14, 1980 [SE] Sweden .....80.08011.2--

Column 8, line 1, Claim 15, after "manufacturing" insert --heat exchanger--.

Signed and Sealed this

Thirteenth Day of July, 1993

*Attest:*

Michael K. Kirk

MICHAEL K. KIRK

*Attesting Officer*

*Acting Commissioner of Patents and Trademarks*